US011129406B2

(12) United States Patent
Sirois et al.

(10) Patent No.: US 11,129,406 B2
(45) Date of Patent: Sep. 28, 2021

(54) CONE CLOSURE APPARATUS AND RELATED METHODS

(71) Applicant: CANOPY GROWTH CORPORATION, Smiths Falls (CA)

(72) Inventors: Mike Sirois, Ottawa (CA); John Tutton, Manotick (CA); Robert Watters, Ottawa (CA)

(73) Assignee: CANOPY GROWTH CORPORATION, Smiths Falls (CA)

( * ) Notice: Subject to any disclaimer, the term of this patent is extended or adjusted under 35 U.S.C. 154(b) by 300 days.

(21) Appl. No.: 16/391,505

(22) Filed: Apr. 23, 2019

(65) Prior Publication Data

US 2019/0320710 A1 Oct. 24, 2019

Related U.S. Application Data

(60) Provisional application No. 62/661,348, filed on Apr. 23, 2018, provisional application No. 62/809,998, filed on Feb. 25, 2019, provisional application No. 62/810,010, filed on Feb. 25, 2019, provisional application No. 62/810,017, filed on Feb. 25, 2019.

(51) Int. Cl.

| | |
|---|---|
| ***A24C 5/54*** | (2006.01) |
| ***A24C 5/06*** | (2006.01) |
| ***A24C 5/12*** | (2006.01) |
| ***A24C 5/44*** | (2006.01) |

(52) U.S. Cl.

CPC ..... *A24C 5/06* (2013.01); *A24C 5/12* (2013.01); *A24C 5/44* (2013.01); *A24C 5/54* (2013.01)

(58) Field of Classification Search

CPC .... A24C 5/06; A24C 5/12; A24C 5/46; A24C 5/54

See application file for complete search history.

(56) References Cited

U.S. PATENT DOCUMENTS

| | | | |
|---|---|---|---|
| 3,208,458 | A | 9/1965 | Chalupa |
| 2017/0119043 | A1 | 5/2017 | Swanson |

FOREIGN PATENT DOCUMENTS

| | | | |
|---|---|---|---|
| DE | 9317497 | U1 | 2/1994 |
| KR | 101823941 | B1 | 3/2018 |

OTHER PUBLICATIONS

KR 101823941 translation; Han Sang Un (Year: 2018).*

International Search Report and Written Opinion issued in PCT/CA2019/050503, dated Jul. 23, 2019, 11 pages.

* cited by examiner

*Primary Examiner* — Eric Yaary

(74) *Attorney, Agent, or Firm* — Stinson LLP

(57) ABSTRACT

A cone closure apparatus for production of smoking articles includes: (a) a frame; and (b) at least one cone holder supported by the frame and extending along an axis. The cone holder has a lower grip surface for applying a rotational force about the axis to an outer surface of a lower filled portion of a cone received in the cone holder. The cone having an upper empty portion disposed above the lower filled portion and protruding clear of the lower grip surface to receive a counter-rotational force about the axis, in a direction opposite the rotational force. The closure apparatus further includes (c) a drive supported by the frame for applying at least one of the rotational force and the counter-rotational force to twist the upper empty portion closed when the drive is energized.

27 Claims, 10 Drawing Sheets

CONE CLOSURE APPARATUS AND RELATED METHODS

CROSS-REFERENCE TO RELATED APPLICATIONS

This application is based on and claims priority to U.S. Provisional Application Ser. No. 62/661,348 filed Apr. 23, 2018; U.S. Provisional Application Ser. No. 62/809,998 filed Feb. 25, 2019; U.S. Provisional Application Ser. No. 62/810,010 filed Feb. 25, 2019; and U.S. Provisional Application Ser. No. 62/810,017 filed Feb. 25, 2019, each of which is incorporated herein by reference in its entirety.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The specification relates generally to production of smoking articles, and more specifically, to apparatuses and methods for the closure of filled cones in production of conical smoking articles.

2. Description of Related Art

U.S. Pat. Pub. App. No. 20170119043 A1 (Swanson et al.) discloses a one-at-a-time cigarette forming device, including a hollow truncated conical wrapper holder having a top end and a bottom end and a conically shaped hollow interior tapering from the top end to the bottom end. The top and bottom ends are open. An elongate plunger or tamper shaft having a tamper head on a lower end and sized to insert fully into the wrapper holder's hollow interior is coupled to a cap and stored inside the wrapper holder when not in use.

BRIEF SUMMARY OF THE INVENTION

The following summary is intended to introduce the reader to various aspects of the applicant's teaching, but not to define any invention.

According to some aspects, a cone closure apparatus for production of smoking articles includes: (a) a frame; and (b) at least one cone holder supported by the frame and extending along an axis. The cone holder has a lower grip surface for applying a rotational force about the axis to an outer surface of a lower filled portion of a cone received in the cone holder. The cone has an upper empty portion disposed above the lower filled portion and protruding clear of the lower grip surface to receive a counter-rotational force about the axis, in a direction opposite the rotational force. The apparatus further includes (c) a drive supported by the frame for applying at least one of the rotational force and the counter-rotational force to twist the upper empty portion closed when the drive is energized.

In some examples, the drive comprises a lower drive coupled to the cone holder, and the lower drive, when energized, urges rotation of the lower grip surface and the lower filled portion of the cone engaged thereby.

In some examples, the counter-rotational force comprises generally inhibiting rotation of the upper empty portion of the cone about the axis during rotation of the lower filled portion of the cone.

In some examples, the lower drive comprises a torque limiter to limit the rotational force to an amount no greater than that necessary to complete the twist closure, thereby inhibiting over twisting the cone. In some examples, the torque limiter comprises a clutch. In some examples, the torque limiter comprises an electronic sensor coupled to the drive, the sensor detecting an increase in torque required to rotate the lower grip surface as the upper empty portion becomes fully twisted about the axis. In some examples, a speed at which the lower grip surface rotates is adjustable.

In some examples, the upper empty portion is accessible by a hand of an operator for applying the counter-rotational force.

In some examples, the apparatus further comprises an upper gripper supported by the frame. The upper gripper is movable between a retracted position in which the upper gripper is clear of the upper empty portion of the cone, and an advanced position in which the upper gripper engages the upper empty portion of the cone to apply the counter-rotational force.

In some examples, the upper gripper comprises at least two jaws. The jaws have opposed upper grip surfaces, and the jaws are movable between open and closed positions. Moving the upper gripper to the advanced position comprises moving the jaws from the open position, in which the upper grip surfaces are spaced apart to receive the upper empty portion of the cone there between in a generally uncollapsed condition, to the closed position, in which the upper grip surfaces are drawn together to collapse the upper empty portion of the cone toward the axis and apply the counter-rotational force.

In some examples, the upper gripper is vertically translatable between a raised position and a lowered position, and moving the gripper to the advanced position comprises moving the gripper to the lowered position.

In some examples, the apparatus comprises an upper gripper supported by the frame, the upper gripper movable between a retracted position in which the upper gripper is clear of the upper empty portion of the cone, and an advanced position in which the upper gripper engages the upper empty portion of the cone to apply the counter-rotational force. In some examples, the drive comprises an upper drive coupled to the upper gripper. The upper drive, when energized, urges counter-rotation of the upper gripper about the axis and the upper filled portion of the cone engaged thereby.

In some examples, the rotational force comprises generally inhibiting rotation of the lower filled portion of the cone relative to the frame during counter-rotation of the upper empty portion of the cone.

In some examples, the lower grip surface is generally conical, having a taper angle that matches a taper angle of the cone.

In some examples, the lower grip surface has an axial extent that extends between a bottom end and a top end. The top end is at an elevation below a fill level of the cone, and the bottom end is below the top end.

In some examples, the cone holder is a selected cone holder from a group of interchangeable cone holders. The group of interchangeable cone holders include the selected cone holder and one or more other cone holders. The one or more other cone holders have respective other grip surfaces with at least one of a different taper angle and a different axial extent suitable for use with a different cone having different geometrical dimensions than the cone received in the selected cone holder.

In some examples, the apparatus further comprises a trimming device supported by the frame. The trimming device includes a cutter movable from a retracted position spaced apart from the twisted upper end of the cone to an advanced position in which the cutter engages the twisted upper end of the cone axially above the filled lower portion of the cone to trim the twisted upper end to a desired length.

According to some aspects, a method of closing a cone containing smokeable product in production of smoking articles comprises: (a) inserting the cone into a cone holder having an axis, the cone holder having a lower grip surface for gripping an outer surface of a lower filled portion of the cone, the cone having an upper empty portion disposed above the lower filled portion and protruding clear of the lower grip surface; (b) energizing a drive coupled to the cone holder, the drive applying a rotational force about the axis to the lower filled portion of the cone via the lower grip surface; and (c) during step (b), applying a counter-rotational force about the axis to the upper empty portion of the cone to twist the upper empty portion closed.

In some examples, the counter-rotational force includes inhibiting rotation of the upper empty portion of the cone about the axis.

In some examples, the counter-rotational force is applied by a hand of an operator.

In some examples, the counter-rotational force is applied by opposed upper grip surfaces of a mechanical gripper moved from a retracted position to an advanced position.

According to some aspects, a cone closure apparatus for production of smoking articles comprises: (a) a frame; (b) at least one cone holder supported by the frame and having a cavity extending along an axis for receiving a lower filled portion of a cone, the cone having an upper empty portion disposed above the lower filled portion and protruding clear of the cone holder; and (c) a set of jaws supported by the frame. The jaws are movable between open and closed positions. The jaws are clear of the cavity and cone received therein when in the open position. The jaws overlie the cavity when in the closed position. When the cone is received in the cavity, the upper empty portion of the cone is folded downward against the lower filled portion to close the cone when the jaws move from the open position to the closed position.

In some examples, each jaw is pivotable about a respective jaw pivot axis for pivotal movement between the open and closed positions.

In some examples, the apparatus further comprises a respective jaw actuator coupled to each jaw for moving the respective jaw between the open and closed positions. In some examples, the apparatus further comprises a controller configured to operate each actuator to move the jaws from the open position to the closed position sequentially about the circumference of the cavity.

In some examples, the set of jaws comprises six jaws arranged circumferentially about the cavity.

According to some aspects, a method of closing a cone containing smokeable product in production of smoking articles, comprises: (a) inserting a cone having a lower filled portion filled with smokeable product into a cavity of a cone holder, the cone having an upper empty portion above the lower filled portion and protruding clear of the cone holder; and (b) folding the upper empty portion downward against the lower filled portion by moving a plurality of jaws from an open position in which the jaws are clear of the cavity to a closed position in which the jaws overly the cavity.

In some examples, the plurality of jaws are arranged circumferentially around the cavity, and step (b) comprises urging the jaws to the advanced position one at a time in sequence about the circumference of the cavity.

In some examples, the method further comprises measuring a closing force applied by the jaws against the lower filled portion when moved toward the closed position and arresting further movement of the jaws upon detecting a closing force in excess of a pre-determined value.

According to some aspects, a method of closing a cone containing smokeable product in production of smoking articles, comprises: (a) gripping a lower filled portion of a cone with a lower grip surface of a cone holder, the cone having an upper empty portion disposed above the lower filled portion and protruding clear of the lower grip surface; (b) gripping the upper empty portion with an upper grip surface; and (c) counter-rotating the upper empty portion relative to the lower filled portion by energizing a drive to rotate one of the upper grip surface and the lower grip surface about an axis and inhibiting rotation of the other of the upper grip surface and the lower grip surface about the axis to twist the upper empty portion closed.

In some examples, step (b) comprises gripping the upper empty portion with a hand of an operator.

In some examples, step (b) comprises gripping the upper empty portion with a mechanical gripper.

In some examples, energizing the drive rotates the lower grip surface about the axis and rotation of the upper grip surface about the axis is inhibited.

In some examples, energizing the drive rotates the upper grip surface about the axis and rotation of the lower grip surface about the axis is inhibited.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION OF PREFERRED EMBODIMENT

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
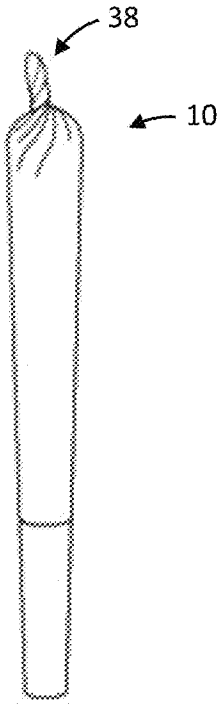
FIG. 1 is a perspective view of an example conical smoking article.

Smoking articles having a conical shape, like that of the example smoking article 10 shown in FIG. 1, are popular among a variety of users, including, for example, cannabis users. Smoking articles having a conical shape are typically hand-made, or otherwise produced in small, labor-intensive batches. In contrast, cylindrical smoking articles, such as traditional tobacco cigarettes, are often manufactured in high volume production systems with a high degree of sophisticated automation. But the difference in shape, among other reasons, can render the processes and apparatus of such automated systems inapplicable to conically shaped smoking articles such as the article 10.

Figure 2B:
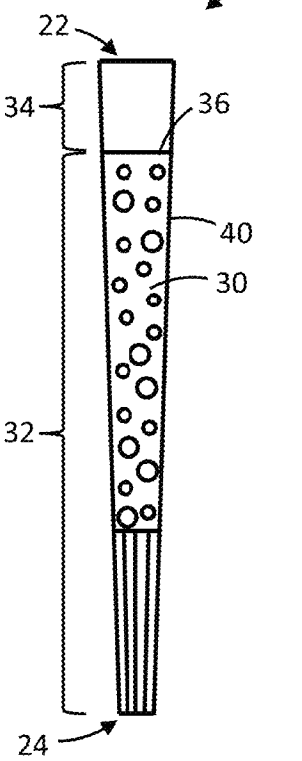
FIG. 2B is a cross-sectional view like that of FIG. 2A, showing the cone filled with a smokeable product.
Figure 2A:
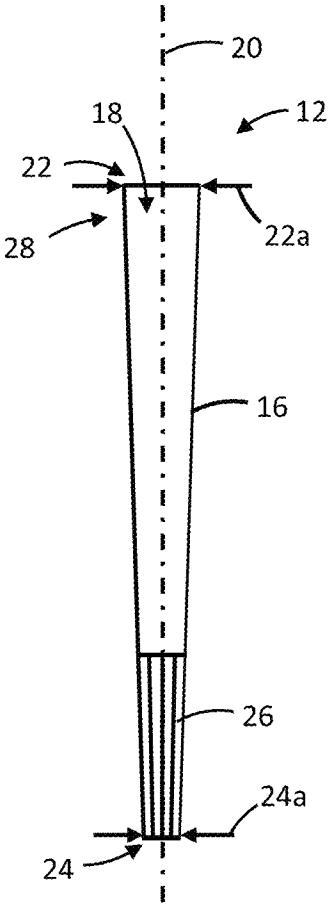
FIG. 2A is a cross-sectional view of the cone of FIG. 2, taken along line 2A-2A of FIG. 2.
Figure 2:
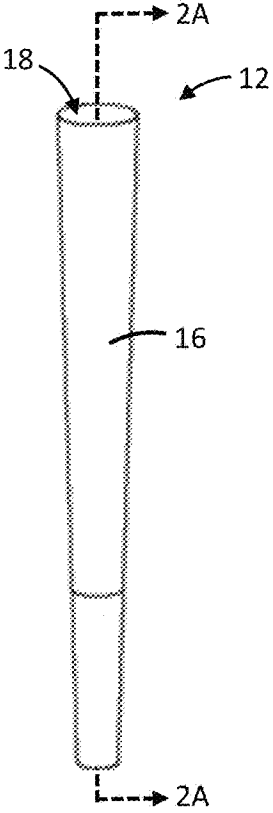
FIG. 2 is a perspective view of an example cone for manufacture of the smoking article of FIG. 1.

Referring to FIGS. 1 and 2, in the example illustrated, the example smoking article 10 is formed using a cone 12. The cone 12 is formed of a smokeable wrapper 16 having a cone cavity 18 for receiving and containing a smokeable product 30 (FIG. 2B). In the example illustrated, the wrapper 16 is generally air impermeable, and the smokeable product 30 is a granular product. In some examples, the cone 12 can be preassembled and the cone cavity 18 can be subsequently filled with the smokeable product 30. The smokeable product 30 can be prepared via chopping, grinding, and/or sifting of a bulk smoking material. The bulk smoking material can include, for example, dried cannabis plant material, and the smokeable product 30 can include cannabis granules.

Referring to FIG. 2A, in the example illustrated, the cone cavity 18 extends along a cone cavity axis 20 between an upper end 22 and a lower end 24 opposite the upper end 22. In the example illustrated, the wrapper 16 has an upper end diameter 22*a* at the upper end 22 of the cavity 18 and a lower end diameter 24*a* at the lower end 24 of the cavity 18. The lower end diameter 24*a* is smaller than the upper end diameter 22*a*, and the wrapper 16 tapers radially inwardly along the cavity axis 20 from the upper end diameter 22*a* to the lower end diameter 24*a* to provide the cone 12 with a generally conical shape. In the example illustrated in FIG. 2A, the upper end 22 of the cavity 18 is open for permitting filling of the cavity 18 with the smokeable product 30. In the example illustrated, the cone 12 includes a filter 26 in the cavity 18 adjacent the lower end 24. The filter 26 can help to provide structural stability to the smoking article 10, and can help inhibit smokeable product 30 in the cavity 18 from escaping through the lower end 24.

Figure 3:
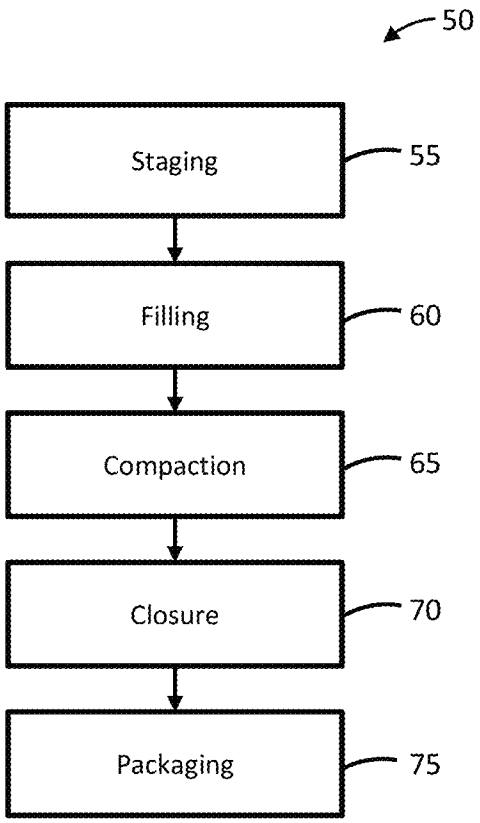
FIG. 3 is a flow chart showing an example process for production of conical smoking articles like that of FIG. 1.

Referring to FIG. 3, an example process 50 for production of conical smoking articles is shown, and will be described with respect to the example smoking article 10.

At step 55 of the process 50, a plurality of the cones 12 are staged for filling with the smokeable product. The cones 12 can be staged by, for example, being positioned in a pallet with the open upper ends 22 directed upwardly for receiving the smokeable product.

At step 60, the staged cones 12 are filled with the smokeable product 30 through respective open upper ends 22 of each cone 12. The cones 12 can be filled while held in the pallet.

At step 65, the smokeable product 30 in the cones 12 is compacted. The smokeable product can be compacted while the cones 12 are held in the pallet. Referring to FIG. 2B, after the smokeable product 30 is compacted, the cone 12 has a lower filled portion 32 filled with the smokeable product 30 and an upper empty portion 34 disposed above the lower filled portion 32. In the example illustrated in FIG. 2B, the lower filled portion 32 extends between the lower end 24 of the cone 12 to an upper surface 36 of the smokeable product 30, and the upper empty portion 34 extends between the upper surface 36 of the smokeable product 30 and the upper end 22 of the cone 12. The upper empty portion 34 can have an axial extent of, for example, about 10 mm between the upper surface 36 of the smokeable product 30 and the upper end 22 of the cone 12.

At step 70, in the example illustrated, the upper end 22 of the cavity 18 is closed to close the filled cone 12, the closed cone inhibiting the smokeable product from escaping from the cavity 18, and forming the finished smoking article 10. In some examples, the cone 12 is closed by twisting the upper empty portion 34 of the cone 12 relative to the lower filled portion 32, thereby closing the upper end 22 of the cavity 18 and forming a twisted upper end 38 (FIG. 1) of the smoking article 10. The cone 12 can be closed while held in cone holders (or cavities) of the pallet, or one or more of the cones 12 can be transferred from the pallet to a separate cone holder to facilitate closure of the cones 12.

After step 70, if the twisted upper end 38 is longer than desired, it can be trimmed by trimming device while still being held in the cone holders (or cavities) of the pallet. In some examples, the cone, or cones 12, can be removed by hand, the upper gripper 1130, a different gripper, or a robotic arm, moved to a trimming station, and trimmed there. The cone, or cones 12, may then be removed by hand, the upper gripper 1130, a different gripper, or a robotic arm, moved to a packaging station.

At step 75, the smoking articles 10 can be packaged for shipment and/or sale.

Figure 4:
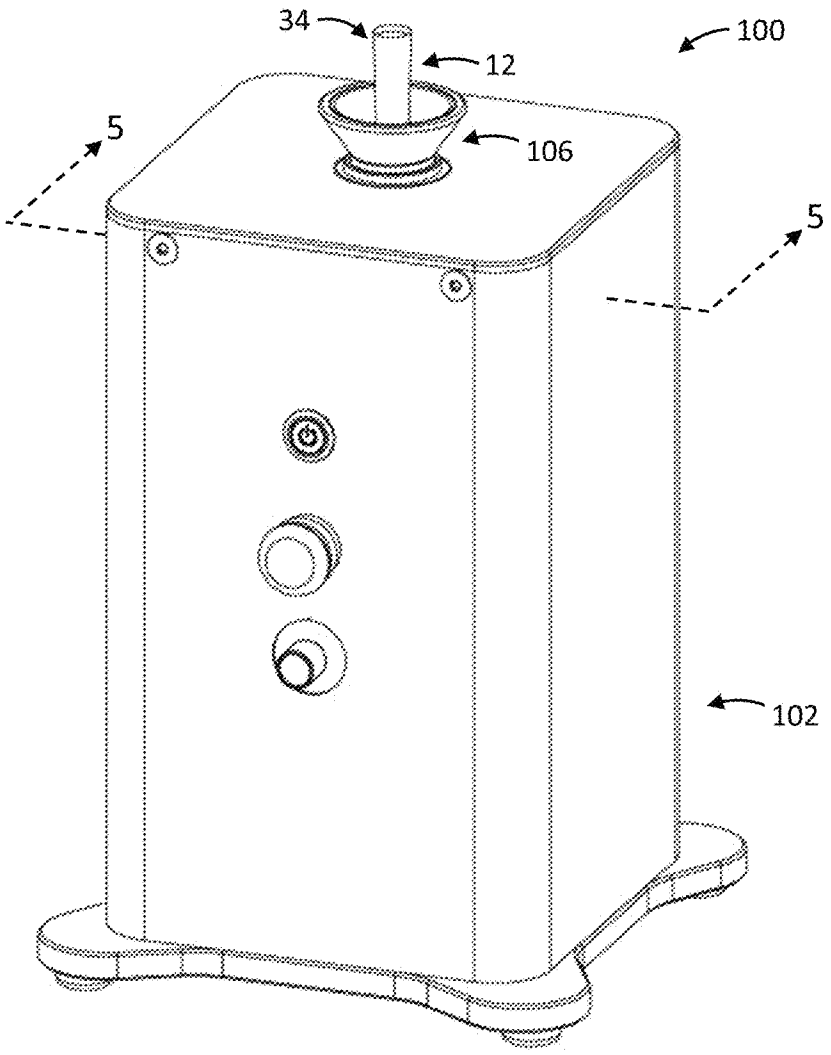
FIG. 4 is a perspective view of an example cone closure apparatus for use with the process of FIG. 3.

Referring to FIG. 4, an example cone closing apparatus 100 for use during the cone closing step 70 is shown, and will be described with respect to the example cone 12 of FIGS. 2-2B.

Figure 5:
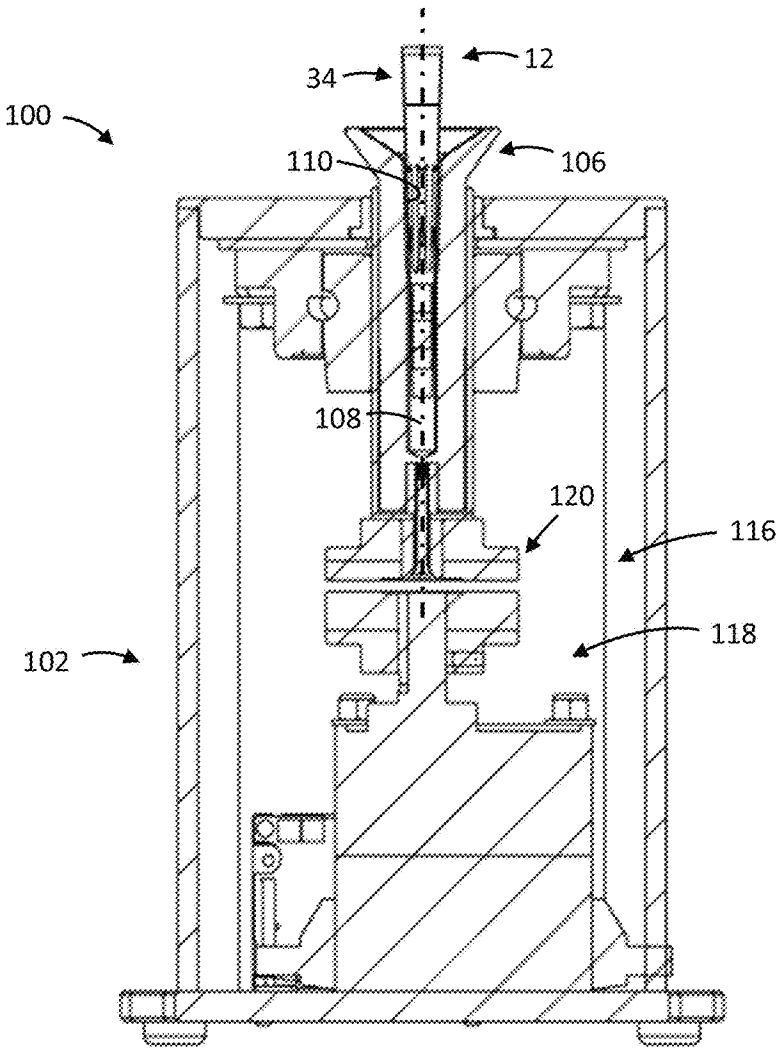
FIG. 5 is a cross-sectional view of the apparatus of FIG. 4, taken along line 5-5 of FIG. 4.

Referring also to FIG. 5, in the example illustrated, the apparatus 100 includes a frame 102 and at least one cone holder 106 supported by the frame 102 and extending along an axis 108. The cone holder 106 has a lower grip surface 110 for applying a rotational force 112 (FIG. 7B) about the axis 108 to an outer surface 40 (FIG. 6) of the lower filled portion 32 of a cone 12 received in the cone holder 106. The upper empty portion 34 of the cone 12 protrudes clear of the lower grip surface 110 to receive a counter-rotational force 114 (FIG. 7B) about the axis 108, in a direction opposite the rotational force 112. Referring to FIG. 8, in the example illustrated, the lower grip surface 110 has an axial extent 111 that extends between a top end 111*a* and a bottom end 111*b*. The top end 111*a* of the axial extent 111 is at an elevation below the upper surface 36 (or fill level) of the smokeable product 30 in the cone 12 (FIG. 2B), and the bottom end 111*b* of the axial extent is below the top end 111*a*.

Referring to FIG. 5, in the example illustrated, the apparatus further includes a drive 116 supported by the frame 102 for applying at least one of the rotational force 112 and the counter-rotational force 114 to twist the upper empty portion 34 closed when the drive 116 is energized. In the example illustrated, the drive 116 comprises an electric motor. In the example illustrated, the drive 116 includes a lower drive 118 coupled to the cone holder 106. The lower drive 118, when energized, urges rotation of the lower grip surface 110 and the lower filled portion 32 of the cone 12 engaged by the lower grip surface 110. In the example illustrated, the lower drive 118 is generally below the cone holder 106 and has an output shaft axis that is generally coaxial with the axis 108.

In the example illustrated, the lower drive 118 comprises a torque limiter 120 to limit the rotational force 112 to an amount no greater than that necessary to complete the twist closure, thereby inhibiting over twisting the cone 12. In the example illustrated, the torque limiter 120 comprises a clutch. In some examples, the torque limiter 120 can include an electronic sensor coupled to the drive 116, and the sensor can be configured to detect an increase in torque required to rotate the lower grip surface 110 as the upper empty portion 34 of the cone 12 becomes fully twisted about the axis 108. In some examples, a speed at which the lower grip surface 110 rotates is adjustable. In another preferred embodiment the user's fingers, while pinching the cone to cause the counter-rotational twist, function as a clutch and sensor, thereby releasing/applying a counter-rotational force, that is sufficient to complete the closure, but not tear the cone.

Figures 7A, 7B, 7C:
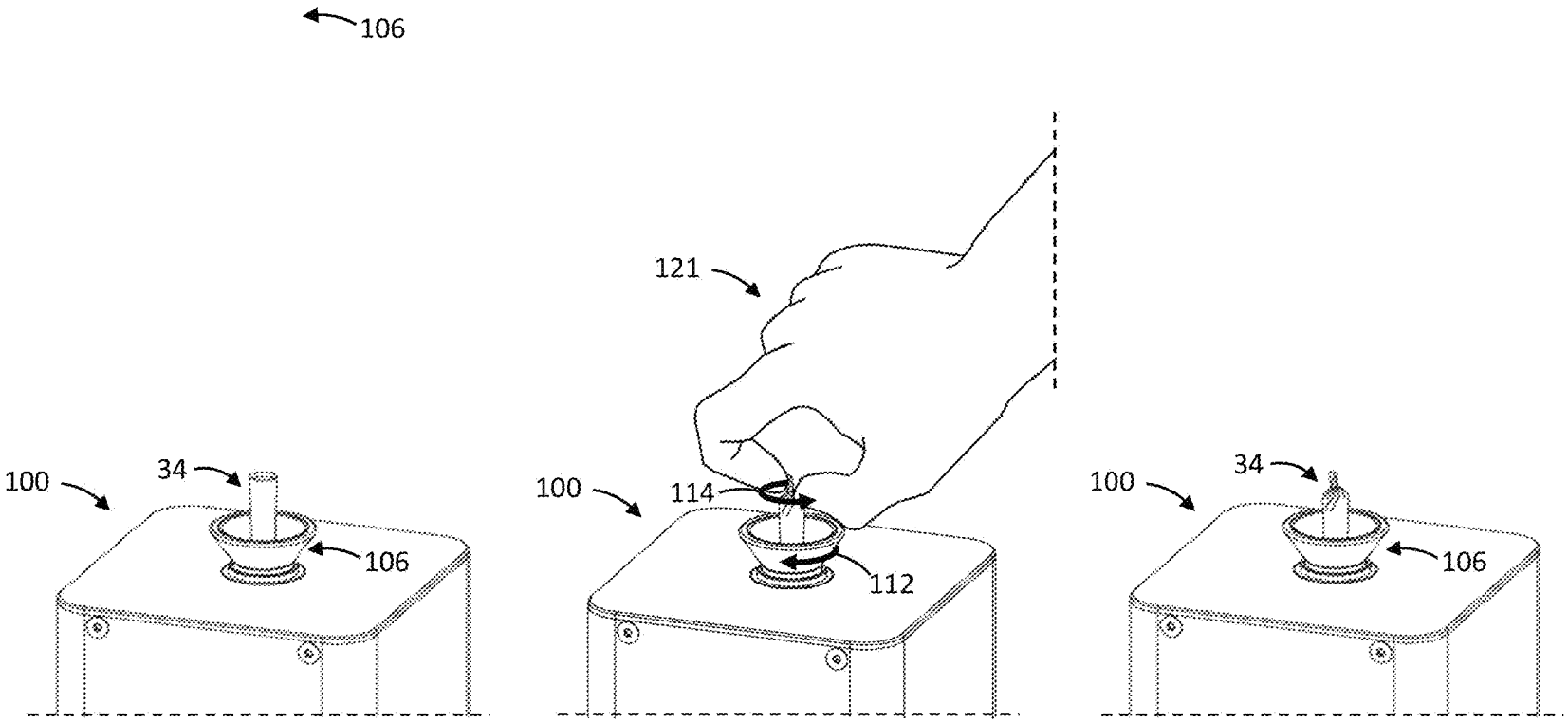
FIG. 7A is a perspective view of a portion of the apparatus of FIG. 4 holding a cone with an open upper portion.
FIG. 7B is a perspective view like that of FIG. 7A, with the upper portion of the cone being gripped.
FIG. 7C is a perspective view like that of FIG. 7A, with the cone having a closed upper portion.
Figure 8:
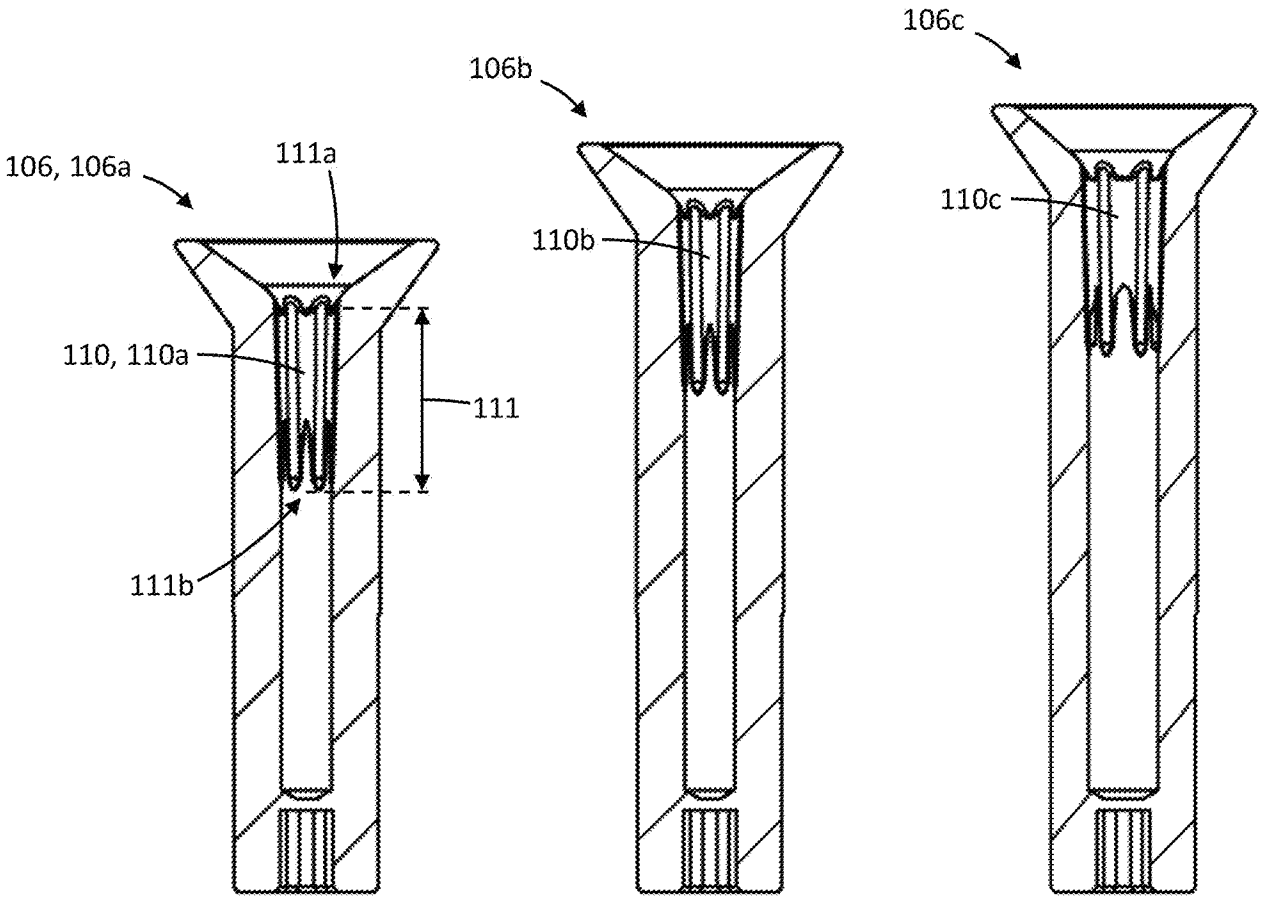
FIG. 8 is a side elevation cross-sectional view of a group of interchangeable cone holders for the apparatus of FIG. 4.

Referring to FIG. 7B, in the example illustrated, the counter-rotational force 114 comprises generally inhibiting rotation of the upper empty portion 34 of the cone 12 about the axis 108 during rotation of the lower filled portion 32 of the cone 12. In the example illustrated, the upper empty portion 34 is gripped by an upper gripping surface to inhibit rotation of the upper empty portion 34 about the axis 108. In the example illustrated, the upper empty portion 34 is accessible by a hand 121 of an operator for applying the counter-rotational force (via gripping the upper empty portion 34).

Figure 6:
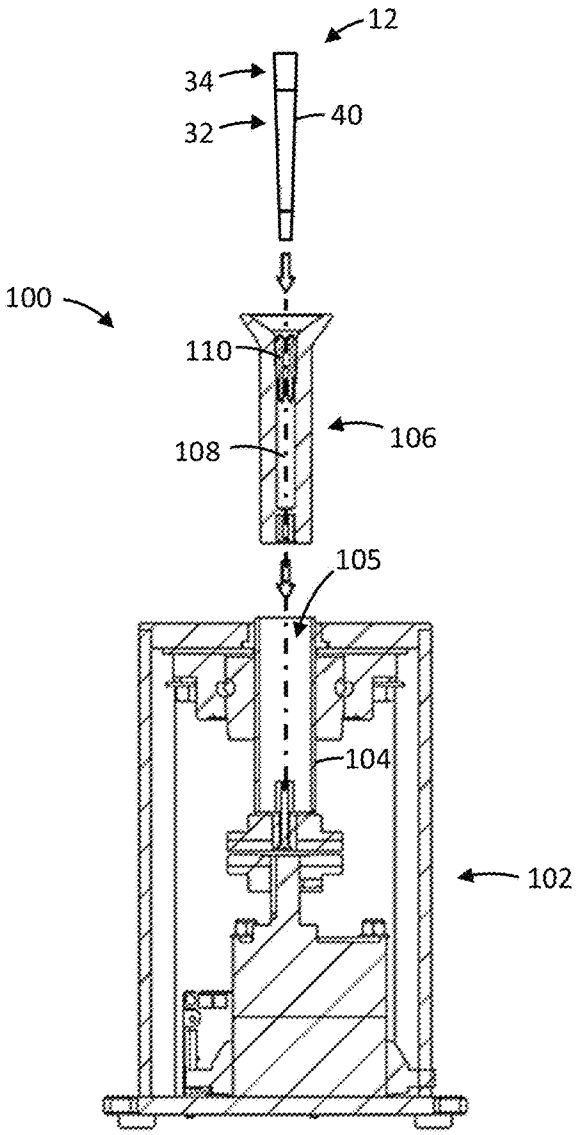
FIG. 6 is a partially exploded view of the apparatus of FIG. 5.

Referring to FIG. 8, in the example illustrated, the cone holder 106 of FIGS. 4-6 is a selected cone holder 106*a* from a group of interchangeable cone holders 106. In the example illustrated, the group of interchangeable cone holders 106 include the selected cone holder 106*a* and one or more other cone holders 106*b*, 106*c*. The selected cone holder 106*a* has a selected grip surface 110*a*, and the one or more other cone holders 106*b*, 106*c* have respective other grip surfaces 110*b*, 110*c* with at least one of a different taper angle, a different diameter, and a different axial extent suitable for use with a different cone having different geometrical dimensions than the cone 12 received in the selected cone holder 106*a*.

Referring to FIG. 6, in the example illustrated, the frame 102 has a receiver 104 with a cavity 105 configured to receive any one of the interchangeable cone holders 106. In some examples, each type of cone holder 106 may have one or more indicators readable by a control system of the apparatus 100 when the cone holder is installed to automatically select operating parameters (e.g. rotation speed, torque limit, etc.) suitable for that type of cone holder 106.

Figure 9C:
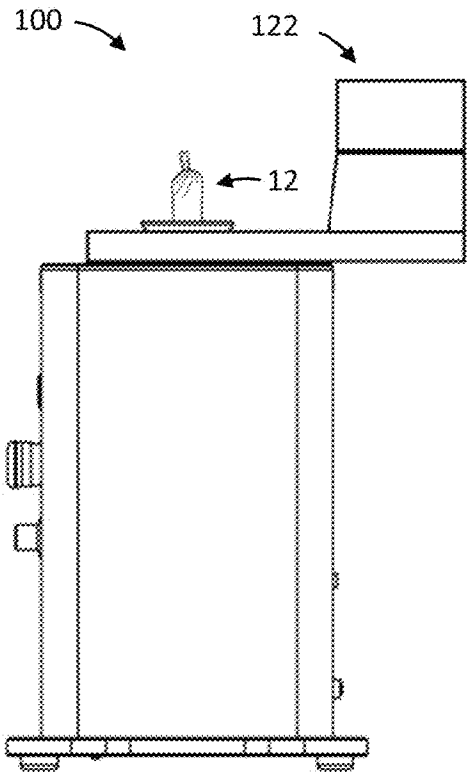
FIG. 9C is a side elevation view like that of FIG. 9A, and with the trimming device in the retracted configuration and the closed upper end of the cone trimmed.
Figure 9B:
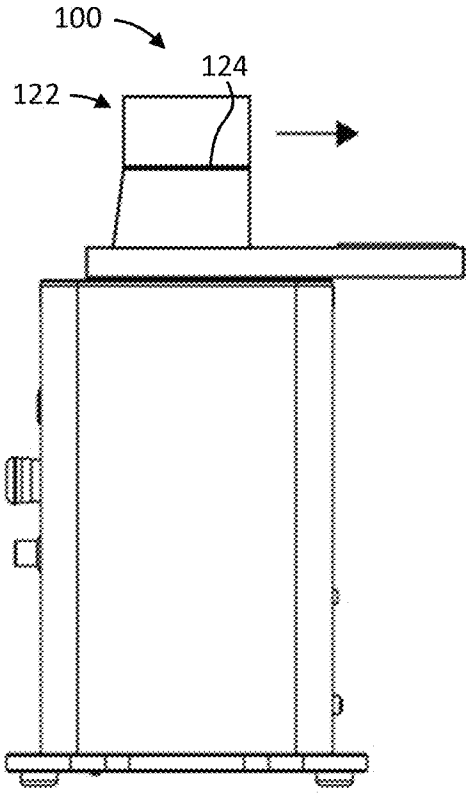
FIG. 9B is a side elevation view like that of FIG. 9A, and with the trimming device in an advanced configuration.
Figure 9A:
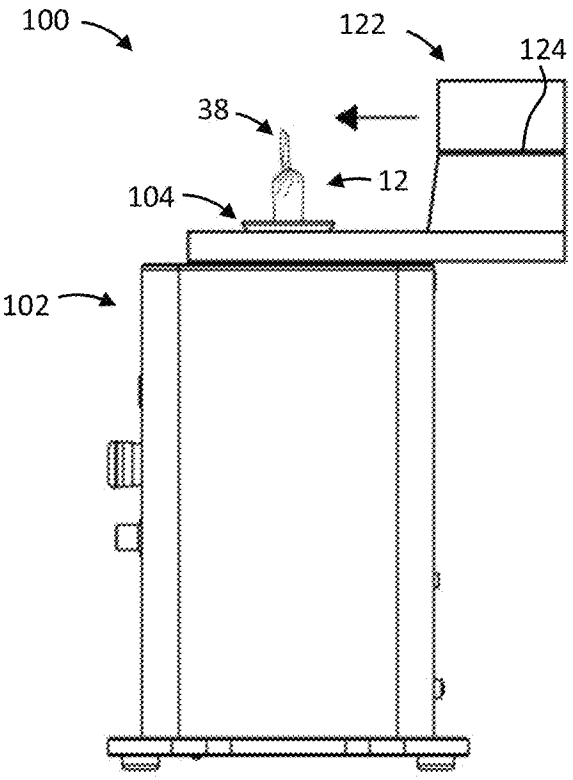
FIG. 9A is a side elevation view of the apparatus of FIG. 4 holding a cone having a closed upper end and with the apparatus including an optional trimming device in a retracted configuration.

Referring to FIG. 9A to 9C, the apparatus 100 can optionally include a trimming device 122 supported by the frame 102. In the example illustrated, the trimming device 122 includes a cutter 124 (shown schematically in FIG. 9A) movable from a retracted position (FIG. 9A) spaced apart from the twisted upper end 38 of the cone 12 to an advanced position (FIG. 9B) in which the cutter 124 engages the twisted upper end 38 of the cone 12 to trim the twisted upper end 38 to a desired length. The cutter 124 can include, for example, a blade, scissors, a cigar-type cutter, a rotatable cutting wheel, and/or any other type of suitable cutter.

Figure 10:
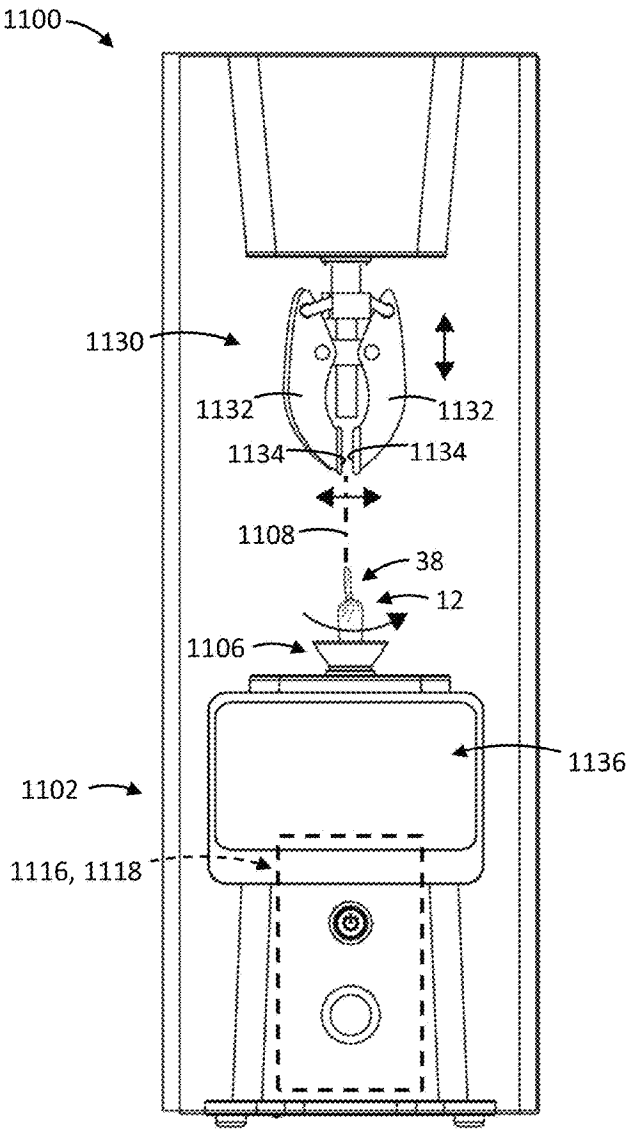
FIG. 10 is a front elevation view of another example cone closure apparatus.

Referring to FIG. 10, another example closure apparatus 1100 is shown. The apparatus 1100 has similarities to the apparatus 100, and like features are identified with like reference characters, incremented by 1000.

In the example illustrated, the apparatus 1100 includes a frame 1102 and at least one cone holder 1106 supported by the frame 1102. The cone holder 1106 has a lower grip surface (like the grip surface 110) for applying a rotational force about an axis 1108 to an outer surface 40 (FIG. 2B) of the lower filled portion 32 (FIG. 2B) of a cone 12 received in the cone holder 1106. When the cone 12 is positioned in the cone holder 1106, the upper empty portion 34 (FIG. 2B) of the cone 12 protrudes clear of the lower grip surface to receive a counter-rotational force about the axis 1108, in a direction opposite the rotational force.

In the example illustrated, the apparatus 1100 further includes a drive 1116 (shown schematically in dashed lines in FIG. 10) supported by the frame 1102 for applying at least one of the rotational force and the counter-rotational force to twist the upper empty portion 34 closed when the drive 1116 is energized (for forming the twisted upper end 38 shown in FIG. 10). In the example illustrated, the drive 1116 includes a lower drive 1118 (shown schematically in dashed lines in FIG. 10) coupled to the cone holder 1106. The lower drive 1118, when energized, urges rotation of the lower grip surface of the cone holder 1106 and the lower filled portion 32 of the cone 12 engaged by the lower grip surface.

In the example illustrated, the apparatus 1100 includes an upper gripper 1130 supported by the frame 1102. The upper gripper 1130 is movable between a retracted position in which the upper gripper 1130 is clear of the upper empty portion 34 of the cone 12, and an advanced position in which the upper gripper 1130 engages the upper empty portion 34 of the cone 12 to apply the counter-rotational force.

In the example illustrated, the upper gripper 1130 includes at least two jaws 1132. The jaws 1132 have opposed upper grip surfaces 1134, and the jaws 1132 are movable between open and closed positions. In the example illustrated, moving the upper gripper 1130 to the advanced position includes moving the jaws from the open position, in which the upper grip surfaces 1134 are spaced apart to receive the upper empty portion 34 of the cone 12 therebetween in a generally uncollapsed condition (e.g. as shown in FIG. 2B), to the closed position, in which the upper grip surfaces 1134 are drawn together to collapse the upper empty portion 34 of the cone 12 toward the axis 1108 and apply the counter-rotational force.

In the example illustrated, the upper gripper 1130 is vertically translatable between a raised position distal the cone 12 and a lowered position proximate the cone 12. In the example illustrated, moving the gripper 1130 to the advanced position comprises moving the gripper 1130 to the lowered position. In some examples, the gripper 1130 can comprise, for example, an electromechanical system operable by a controller based on, for example, sensor feedback. In some examples, the gripper 1130 can comprise, for example, a robotic system with sensors (e.g. a machine vision system) to facilitate calibration, operation, and/or adjustment of the gripper 1130.

In the example illustrated, the apparatus 1100 further includes a display 1136 supported by the frame 1102. The display 1136 may be used to, for example, output data relating to operation of the apparatus 1100 (e.g. rotational speed, stage of operation, etc.), receive user input for calibration, operation, and/or adjustment of the apparatus 1100, and/or to otherwise facilitate control and/or feedback with respect to the apparatus 1100.

Figure 11:
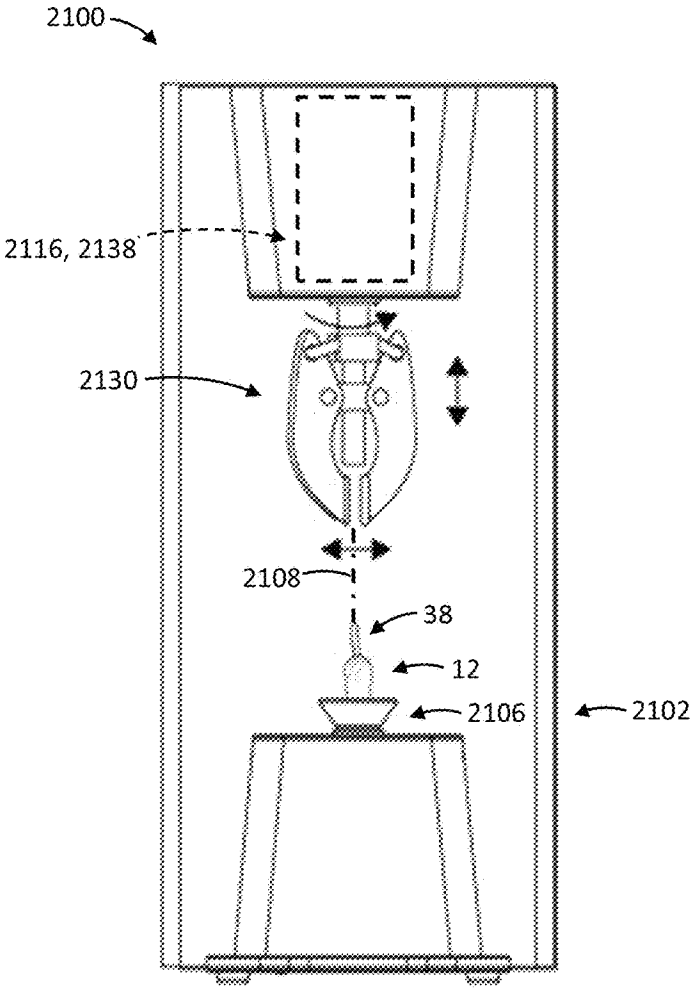
FIG. 11 is a front elevation view of another example cone closure apparatus.

Referring to FIG. 11, another example closure apparatus 2100 is shown. The apparatus 2100 has similarities to the apparatus 1100, and like features are identified with like reference characters, incremented by 1000.

In the example illustrated, the apparatus 2100 includes a frame 2102 and at least one cone holder 2106 supported by the frame 2102. The cone holder 2106 has a lower grip surface (like the grip surface 110) for applying a rotational force about an axis 2108 to an outer surface 40 (FIG. 2B) of the lower filled portion 32 (FIG. 2B) of a cone 12 received in the cone holder 2106. The upper empty portion 34 (FIG. 2B) of the cone 12 protrudes clear of the lower grip surface to receive a counter-rotational force about the axis 2108, in a direction opposite the rotational force. In the example illustrated, the apparatus 2100 further includes a drive 2116 (shown schematically in dashed lines in FIG. 11) supported by the frame 2102 for applying at least one of the rotational force and the counter-rotational force to twist the upper empty portion 34 closed when the drive 2116 is energized (for forming the twisted upper end 38 shown in FIG. 11).

In the example illustrated, the apparatus 2100 includes an upper gripper 2130 supported by the frame 2102. The upper gripper 2130 is movable between a retracted position in which the upper gripper 2130 is clear of the upper empty portion 34 of the cone 12, and an advanced position in which the upper gripper 2130 engages the upper empty portion 34 of the cone 12 to apply the counter-rotational force.

In the example illustrated, the drive 2116 comprises an upper drive 2138 (shown schematically in dashed lines in FIG. 11) coupled to the upper gripper 2130. The upper drive 2138, when energized, urges counter-rotation of the upper gripper 2130 about the axis 2108 and the upper empty portion 34 of the cone 12 engaged thereby. In the example illustrated, the rotational force comprises generally inhibiting rotation of the lower filled portion 32 of the cone 12 relative to the frame 2102 (via engagement with the lower grip surface of the cone holder 2106) during counter-rotation of the upper empty portion 34 of the cone 12 (via rotation of the upper gripper 2130 when in an advanced position). In another example, it is conceived that within the scope of this invention, a device with both an upper drive similar to 2116 or 2138 and lower drive similar to 1116 or 1118 can work cooperatively to provide a rotational and counter rotational force to close the cone.

Figure 12A:
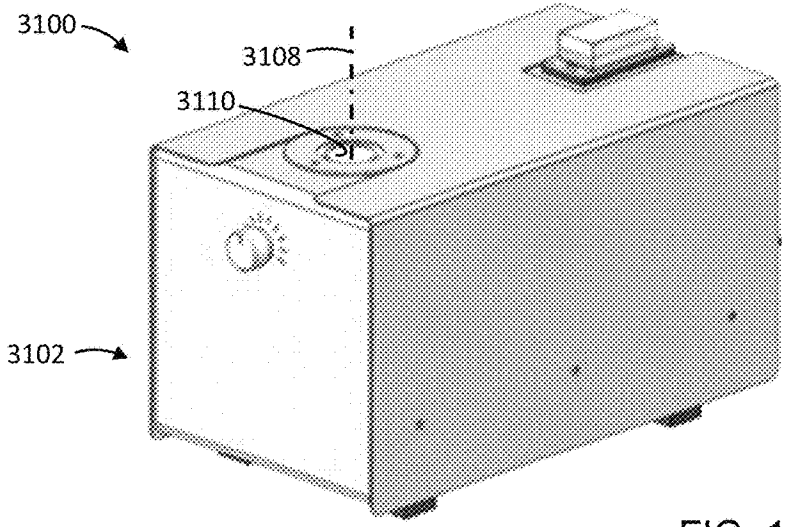
FIG. 12A is a perspective view of another example cone closure apparatus.
Figure 12B:
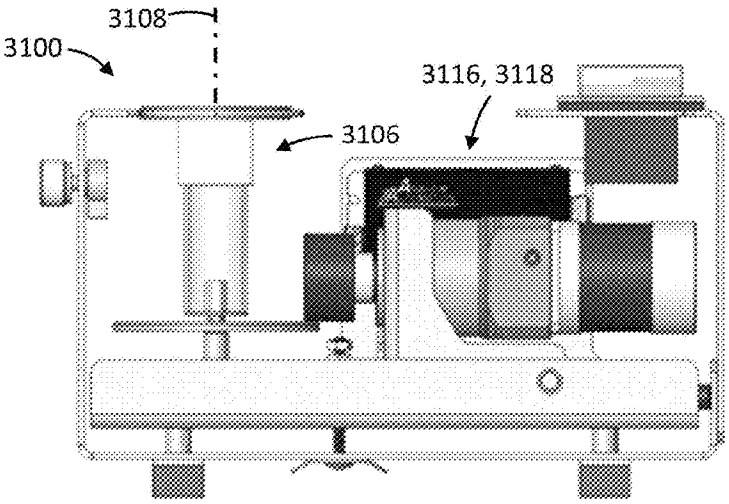
FIG. 12B is a side elevation view of the apparatus of FIG. 12A with a frame casing removed.

Referring to FIGS. 12A and 12B, another example closure apparatus 3100 is shown. The apparatus 3100 has similarities to the apparatus 100, and like features are identified with like reference characters, incremented by 3000.

In the example illustrated, the apparatus 3100 includes a frame 3102 and at least one cone holder 3106 supported by the frame 3102 and extending along an axis 3108. The cone holder 3106 has a lower grip surface 3110 for applying a rotational force about the axis 3108 to an outer surface 40 (FIG. 2B) of the lower filled portion 32 (FIG. 2B) of a cone 12 (FIG. 2B) received in the cone holder 3106. When the cone 12 is in the cone holder 3106, the upper empty portion 34 (FIG. 2B) of the cone 12 protrudes clear of the lower grip surface 3110 to receive a counter-rotational force about the axis 3108, in a direction opposite the rotational force.

In the example illustrated, the apparatus 3100 includes a drive 3116 supported by the frame 3102 for applying at least one of the rotational force and the counter-rotational force to twist the upper empty portion 34 closed when the drive 3116 is energized. In the example illustrated, the drive 3116 includes a lower drive 3118 coupled to the cone holder 3106. The lower drive 3118, when energized, urges rotation of the lower grip surface 3110 and the lower filled portion 32 of the cone 12 engaged by the lower grip surface 3110. In the example illustrated, the lower drive 3118 is generally horizontally offset from the cone holder 3106 and has an output shaft axis oriented generally horizontally (perpendicular to the axis 3108, which is generally vertical).

Figure 13:
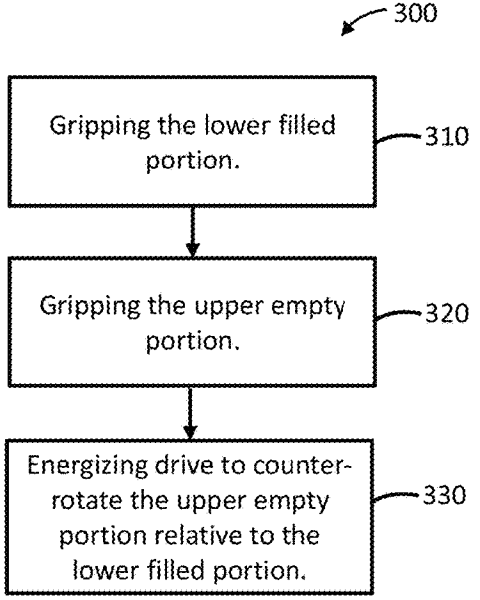
FIG. 13 is a flow chart showing an example process for closing a cone containing smokeable product in production of smoking articles.

Referring to FIG. 13, an example process 300 of closing a cone containing smokeable product in production of smoking articles is shown, and will be described mainly with respect to the apparatus 100.

At step 310 of the process 300, the lower filled portion 32 of a cone 12 is gripped with the lower grip surface 110 of the cone holder 106, and the upper empty portion 34 of the cone 12 is disposed above the lower filled portion 32 and protrudes clear of the lower grip surface 110.

At step 320, the upper empty portion 34 is gripped with an upper grip surface. When the process 300 is used with an apparatus similar to, for example, apparatus 100 or 3100, step 320 can include gripping the upper empty portion 34 with a hand of an operator. When the process 300 is used with an apparatus similar to, for example, apparatus 1100 or 2100, step 320 can include gripping the upper empty portion 34 with a mechanical gripper (e.g. gripper 1130 or 2130).

At step 330, the upper empty portion 34 is counter-rotated relative to the lower filled portion 32 by energizing a drive (e.g. drive 116) to rotate one of the upper grip surface and the lower grip surface about an axis (e.g. axis 108) and inhibiting rotation of the other of the upper grip surface and the lower grip surface about the axis to twist the upper empty portion 34 closed. When the process 300 is used with an apparatus similar to, for example, the apparatus 100, 1100, or 3100, energizing the drive rotates the lower grip surface about the axis and rotation of the upper grip surface about the axis is inhibited. When the process 300 is used with an apparatus similar to, for example, the apparatus 2100, energizing the drive rotates the upper grip surface about the axis and rotation of the lower grip surface about the axis is inhibited.

Figure 14B:
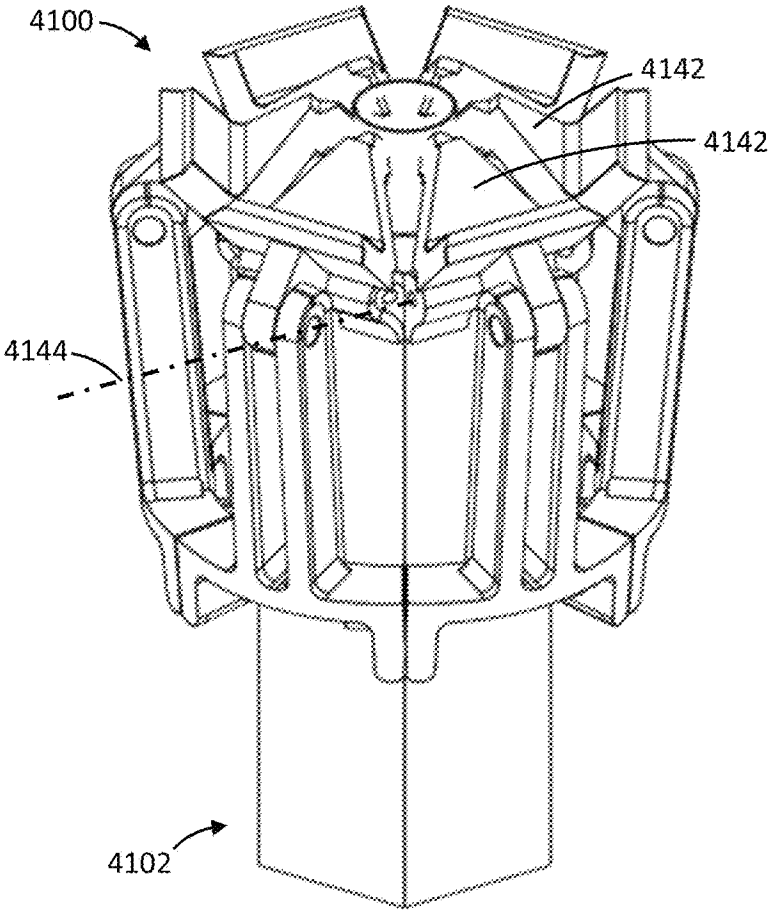
FIG. 14B is a perspective view like that of FIG. 14A and with the apparatus in an intermediate configuration.
Figure 14A:
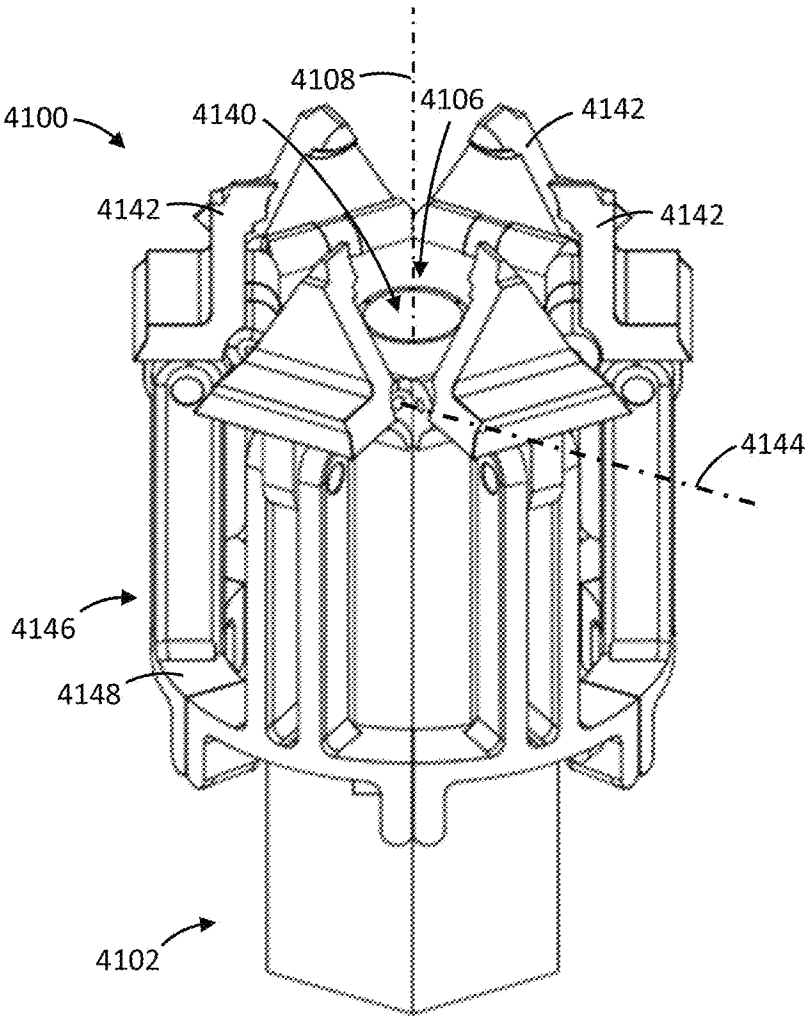
FIG. 14A is a perspective view of another example cone closure apparatus in an open configuration.

Referring to FIG. 14A, another example cone closure apparatus 4100 is shown. The apparatus 4100 has similarities to the apparatus 100, and like features are identified with like reference characters, incremented by 4000.

In the example illustrated, the apparatus 4100 includes a frame 4102 and at least one cone holder 4106 supported by the frame 4102. The cone holder 4106 has a cavity 4140 extending along an axis 4108 for receiving a lower filled portion 32 (FIG. 2B) of a cone 12 having an upper empty portion 34 (FIG. 2B) disposed above the lower filled portion 32 and protruding clear of the cone holder 4106.

Figure 14C:
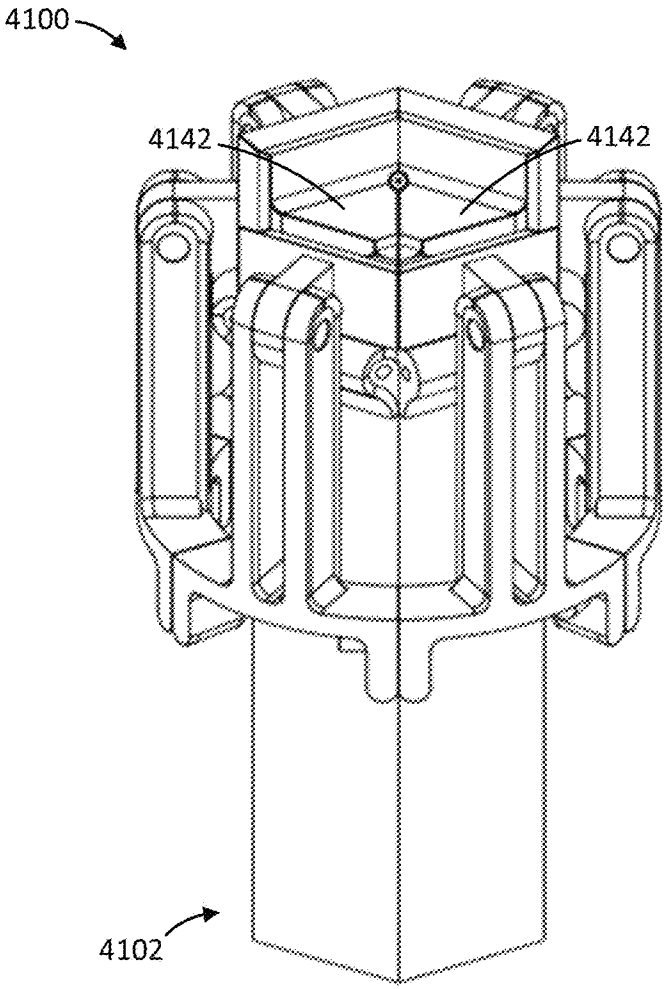
FIG. 14C is a perspective view like that of FIG. 14A and with the apparatus in a closed configuration.

In the example illustrated, the apparatus 4100 includes a set of jaws 4142 supported by the frame 4102. Referring to FIGS. 14A to 14C, the jaws 4142 are movable between open and closed positions. Referring to FIG. 14A, when the jaws 4142 are in the open position, the jaws 4142 are clear of the cavity 4140 and the cone 12 can be received in the cavity 4140. Referring to FIG. 14C, when in the closed position, the jaws 4142 overlie the cavity 4140. When the cone 12 is received in the cavity 4140 and the jaws 4142 are moved from the open position to the closed position, the jaws 4142 fold the upper empty portion 34 of the cone 12 downward against the lower filled portion 32 to close the cone 12. In the example illustrated, the set of jaws 4142 comprises six jaws 4142 arranged circumferentially about the cavity 4140. Referring to FIG. 14A, in the example illustrated, each jaw 4142 is pivotable about a respective jaw pivot axis 4144 for pivotal movement between the open and closed positions.

In the example illustrated, the apparatus 4100 includes a jaw actuator 4146 coupled to each jaw 4142 for moving the respective jaw 4142 between the open and closed positions. In the example illustrated, the jaw actuator 4146 comprises a carriage 4148 vertically translatable relative to the frame 4102 for moving the jaws 4142 between the open and closed positions.

In some examples, the apparatus 4100 can include a respective jaw actuator coupled to each jaw 4142 for moving the respective jaw 4142 between the open and closed positions. In some examples, the apparatus 4100 can include a controller configured to operate the respective jaw actuators to move the jaws 4142 from the open position to the closed position sequentially about the circumference of the cavity 4140.

Figure 15:
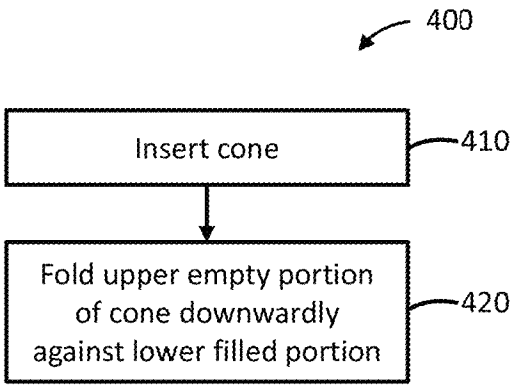
FIG. 15 is a flow chart showing another example process for closing a cone containing smokeable product in production of smoking articles.

Referring to FIG. 15, an example process 400 of closing a cone containing smokeable product in production of smoking articles is shown, and will be described with respect to the apparatus 4100.

At step 410 of the process 400, a cone 12 having a lower filled portion 32 filled with smokeable product 30 is inserted into the cavity 4140 of the cone holder 4106. The cone 12 has an upper empty portion 34 above the lower filled portion 32 and protruding clear of the cone holder 4106.

At step 420, the upper empty portion 34 is folded downwardly against the lower filled portion 32 by moving the plurality of jaws 4142 from the open position in which the jaws 4142 are clear of the cavity 4140 to the closed position in which the jaws 4142 overly the cavity 4140.

In the example illustrated, the plurality of jaws 4142 are arranged circumferentially around the cavity 4140, and in some examples, step 420 can include urging the jaws 4142 to the advanced position one at a time in sequence about the circumference of the cavity 4140.

In some examples, the process 400 can further include measuring a closing force applied by the jaws 4142 against the lower filled portion 32 when the jaws 4142 are moved toward the closed position and arresting further movement of the jaws 4142 upon detecting a closing force in excess of a pre-determined value.

In some examples, the cone holder 106 continuously turns/spins (not stopping at the end of the twist). The user Drops the cone into the already spinning holder, applies a force to twist, applies increased force to grip while pulling up to remove the cone. Then grabs a new empty cone and inserts in into the already spinning cone holder 106, repeating the process until the desired number of cones have been processed.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A cone closure apparatus for production of smoking articles, comprising:

a) a frame;

b) at least one cone holder supported by the frame and extending along an axis, the cone holder having a lower grip surface for applying a rotational force about the axis to an outer surface of a lower filled portion of a cone received in the cone holder, the cone having an upper empty portion disposed above the lower filled portion and protruding clear of the lower grip surface to receive a counter-rotational force about the axis, in a direction opposite the rotational force; and c) a drive supported by the frame for applying at least one of the rotational force and the counter-rotational force to twist the upper empty portion closed when the drive is energized.

2. The apparatus of claim 1, wherein the drive comprises a lower drive coupled to the cone holder, the lower drive, when energized, urging rotation of the lower grip surface and the lower filled portion of the cone engaged thereby.

3. The apparatus of claim 2, wherein the counter-rotational force comprises generally inhibiting rotation of the upper empty portion of the cone about the axis during rotation of the lower filled portion of the cone.

4. The apparatus of claim 3, wherein the lower drive comprises a torque limiter to limit the rotational force to an amount no greater than that necessary to complete the twist closure, thereby inhibiting over twisting the cone.

5. The apparatus of claim 4, wherein the torque limiter comprises a clutch.

6. The apparatus of claim 4, wherein the torque limiter comprises an electronic sensor coupled to the drive, the sensor detecting an increase in torque required to rotate the lower grip surface as the upper empty portion becomes fully twisted about the axis.

7. The apparatus of claim 3, wherein a speed at which the lower grip surface rotates is adjustable.

8. The apparatus of claim 3, wherein the upper empty portion is accessible by a hand of an operator for applying the counter-rotational force.

9. The apparatus of claim 3, further comprising an upper gripper supported by the frame, the upper gripper movable between a retracted position in which the upper gripper is clear of the upper empty portion of the cone, and an advanced position in which the upper gripper engages the upper empty portion of the cone to apply the counter-rotational force.

10. The apparatus of claim 9, wherein the upper gripper comprises at least two jaws, the jaws having opposed upper grip surfaces, and the jaws movable between open and closed positions, wherein moving the upper gripper to the advanced position comprises moving the jaws from the open position, in which the upper grip surfaces are spaced apart to receive the upper empty portion of the cone therebetween in a generally uncollapsed condition, to the closed position, in which the upper grip surfaces are drawn together to collapse the upper empty portion of the cone toward the axis and apply the counter-rotational force.

11. The apparatus of claim 10, wherein the upper gripper is vertically translatable between a raised position and a lowered position, and wherein moving the gripper to the advanced position comprises moving the gripper to the lowered position.

12. The apparatus of claim 1, further comprising an upper gripper supported by the frame, the upper gripper movable between a retracted position in which the upper gripper is clear of the upper empty portion of the cone, and an advanced position in which the upper gripper engages the upper empty portion of the cone to apply the counter-rotational force.

13. The apparatus of claim 12, wherein the drive comprises an upper drive coupled to the upper gripper, the upper drive, when energized, urging counter-rotation of the upper gripper about the axis and the upper filled portion of the cone engaged thereby.

14. The apparatus of claim 13, wherein the rotational force comprises generally inhibiting rotation of the lower filled portion of the cone relative to the frame during counter-rotation of the upper empty portion of the cone.

15. The apparatus of claim 1, wherein the lower grip surface is generally conical, having a taper angle that matches a taper angle of the cone.

16. The apparatus of claim 15, wherein the lower grip surface has an axial extent that extends between a bottom end and a top end, wherein the top end is at an elevation below a fill level of the cone, and the bottom end is below the top end.

17. The apparatus of claim 15, wherein the cone holder is a selected cone holder from a group of interchangeable cone holders, the group of interchangeable cone holders including the selected cone holder and one or more other cone holders, the one or more other cone holders having respective other grip surfaces with at least one of a different taper angle and a different axial extent suitable for use with a different cone having different geometrical dimensions than the cone received in the selected cone holder.

18. The apparatus of claim 1, further comprising a trimming device supported by the frame, the trimming device including a cutter movable from a retracted position spaced apart from the twisted upper end of the cone to an advanced position in which the cutter engages the twisted upper end of the cone axially above the filled lower portion of the cone to trim the twisted upper end to a desired length.

19. A method of closing a cone containing smokeable product in production of smoking articles, the method comprising:

a) inserting the cone into a cone holder having an axis, the cone holder having a lower grip surface for gripping an outer surface of a lower filled portion of the cone, the cone having an upper empty portion disposed above the lower filled portion and protruding clear of the lower grip surface;

b) energizing a drive coupled to the cone holder, the drive applying a rotational force about the axis to the lower filled portion of the cone via the lower grip surface;

c) during step (b), applying a counter-rotational force about the axis to the upper empty portion of the cone to twist the upper empty portion closed.

20. The method of claim 19, wherein the counter-rotational force includes inhibiting rotation of the upper empty portion of the cone about the axis.

21. The method of claim 19, wherein the counter-rotational force is applied by a hand of an operator.

22. The method of claim 19, wherein the counter-rotational force is applied by opposed upper grip surfaces of a mechanical gripper moved from a retracted position to an advanced position.

23. A method of closing a cone containing smokeable product in production of smoking articles, the method comprising:

a) gripping a lower filled portion of a cone with a lower grip surface of a cone holder, the cone having an upper empty portion disposed above the lower filled portion and protruding clear of the lower grip surface;

b) gripping the upper empty portion with an upper grip surface; and c) counter-rotating the upper empty portion relative to the lower filled portion by energizing a drive to rotate one of the upper grip surface and the lower grip surface about an axis and inhibiting rotation of the other of the upper grip surface and the lower grip surface about the axis to twist the upper empty portion closed.

24. The method of claim 23, wherein step (b) comprises gripping the upper empty portion with a hand of an operator.

25. The method of claim 23, wherein step (b) comprises gripping the upper empty portion with a mechanical gripper.

26. The method of claim 23, wherein energizing the drive rotates the lower grip surface about the axis and rotation of the upper grip surface about the axis is inhibited.

27. The method of claim 23, wherein energizing the drive rotates the upper grip surface about the axis and rotation of the lower grip surface about the axis is inhibited.

* * * * *